US011498726B2

(12) United States Patent
Hansen et al.

(10) Patent No.: US 11,498,726 B2
(45) **Date of Patent: *Nov. 15, 2022**

(54) TAMPER-EVIDENT THERMOFORMED PACKAGING

(71) Applicant: Display Pack, Inc., Cedar Springs, MI (US)

(72) Inventors: Victor D. Hansen, Rockford, MI (US); Andrew J. Blackmore, Belmont, MI (US); Elliott R. Eckert, Belmont, MI (US); Marc R. Meyer, Grand Rapids, MI (US)

(73) Assignee: Display Pack, Inc., Cedar Springs, MI (US)

( * ) Notice: Subject to any disclaimer, the term of this patent is extended or adjusted under 35 U.S.C. 154(b) by 307 days.

This patent is subject to a terminal disclaimer.

(21) Appl. No.: 16/830,760

(22) Filed: Mar. 26, 2020

(65) Prior Publication Data

US 2020/0239201 A1 Jul. 30, 2020

Related U.S. Application Data

(63) Continuation of application No. 16/359,393, filed on Mar. 20, 2019, now Pat. No. 10,611,528, which is a (Continued)

(51) Int. Cl.
*B65D 43/02* (2006.01)

(52) U.S. Cl.
CPC ..... *B65D 43/0235* (2013.01); *B65D 43/0262* (2013.01); *B65D 2401/10* (2020.05); (Continued)

(58) Field of Classification Search
CPC ..... B65D 43/0235; B65D 43/0262; B65D 2401/10; B65D 2543/00101; (Continued)

(56) References Cited

U.S. PATENT DOCUMENTS 3,424,342 A 1/1969 Scopp et al.
5,249,694 A 10/1993 Nelson
(Continued)

FOREIGN PATENT DOCUMENTS

EP 1736417 10/2008

OTHER PUBLICATIONS

D&W Fine Pack LLC, VersaLock package, at least as early as Dec. 31, 2013.

*Primary Examiner* — James N Smalley
(74) *Attorney, Agent, or Firm* — Warner Norcross + Judd LLP

(57) ABSTRACT

A package having a lid seated on a base where the edge of the seated lid is generally inaccessible, and where the edge is made accessible by a movement of a tamper-evident tab. The base and lid are configured so that opening of the tamper-evident tab locks the tab in the opened position. The inner edge of the tamper-evident tab is joined to the base by a hinge. The tamper-evident tab includes a protrusion that extends inwardly beyond the hinge. The lid includes a retention feature overlying the tamper-evident tab. The protrusion interacts with the retention feature to provide an audible indication when the tamper-evident tab is opened and to retain the tamper-evident tab in the opened position. The protrusion may be configured to lift the lid when the tamper-evident tab is in the opened position.

20 Claims, 8 Drawing Sheets

Related U.S. Application Data continuation of application No. 15/464,446, filed on Mar. 21, 2017, now Pat. No. 10,279,962.

(52) U.S. Cl.
CPC ..... *B65D 2543/0062* (2013.01); *B65D 2543/00101* (2013.01); *B65D 2543/00296* (2013.01); *B65D 2543/00685* (2013.01); *B65D 2543/00731* (2013.01); *B65D 2543/00805* (2013.01)

(58) Field of Classification Search
CPC .. B65D 2543/00296; B65D 2543/0062; B65D 2543/00685; B65D 2543/00731; B65D 2543/00805
See application file for complete search history.

(56) References Cited

U.S. PATENT DOCUMENTS

| | | | | |
|---|---|---|---|---|
| 5,507,406 | A | 4/1996 | Urciuoli et al. | |
| D448,991 | S | 10/2001 | Zettle et al. | |
| D475,620 | S | 6/2003 | Chen et al. | |
| 6,644,492 | B1 * | 11/2003 | Mitchell | B65D 43/0212 220/285 |
| 6,700,106 | B2 | 3/2004 | Cochran et al. | |
| D527,956 | S | 9/2006 | Doliwa | |
| 7,118,003 | B2 | 10/2006 | Sellari et al. | |
| D532,294 | S | 11/2006 | Fager et al. | |
| 7,338,209 | B2 | 3/2008 | Winpenny | |
| D589,342 | S | 3/2009 | Maslowski | |
| 7,568,589 | B2 | 8/2009 | Vovan | |
| 7,712,626 | B2 | 5/2010 | Vovan | |
| D634,616 | S | 3/2011 | Hansen et al. | |
| 7,992,743 | B2 | 8/2011 | Vovan | |
| 8,056,750 | B2 | 11/2011 | Vovan | |
| 8,123,064 | B2 | 2/2012 | Vovan | |
| 8,186,531 | B2 | 5/2012 | Parikh et al. | |
| D664,842 | S | 8/2012 | Meyer et al. | |
| 8,251,249 | B1 | 8/2012 | Vovan | |
| 8,256,636 | B2 | 9/2012 | Huffer | |
| D684,046 | S | 6/2013 | Meyer et al. | |
| 8,608,008 | B2 | 12/2013 | Gingras et al. | |
| 8,640,914 | B2 | 2/2014 | Meyer et al. | |
| 2004/0007583 | A1 | 1/2004 | Lin | |
| 2004/0129715 | A1 | 7/2004 | Bagdanovich | |
| 2006/0255054 | A1 | 11/2006 | Vovan | |
| 2007/0045317 | A1 | 3/2007 | Rosender et al. | |
| 2007/0108210 | A1 | 5/2007 | Alvares et al. | |
| 2008/0041850 | A1 | 2/2008 | Tucker et al. | |
| 2008/0257886 | A1 * | 10/2008 | Luburic | B65D 43/0212 220/285 |
| 2009/0120937 | A1 | 5/2009 | Vovan | |
| 2009/0206082 | A1 | 8/2009 | Vovan | |
| 2010/0181323 | A1 | 7/2010 | Thaler et al. | |
| 2010/0224630 | A1 | 9/2010 | Petlak | |
| 2012/0241456 | A1 | 9/2012 | Vovan et al. | |
| 2012/0292322 | A1 | 11/2012 | Meyer et al. | |
| 2013/0020325 | A1 | 1/2013 | Stone | |
| 2013/0098914 | A1 * | 4/2013 | Pudselykke | B65D 43/0256 220/270 |

* cited by examiner

TAMPER-EVIDENT THERMOFORMED PACKAGING

BACKGROUND OF THE INVENTION

The present invention relates to packaging and more particularly to tamper-evident thermoformed packaging.

Thermoformed packaging is used in a wide variety of application. The design and construction of thermoformed packaging typically varies from application to application. One common application for thermoformed packaging is food packaging. For example, fruits and vegetables are now commonly sold in containers made from thermoformed parts. Although food packages may vary in design and construction, one type of common food package includes a thermoformed base and a thermoformed lid that can be closed to cooperatively define an article-receiving space. In some applications, the base and lid are formed from a single portion of thermoplastic material and are joined together along a living hinge. In other applications, the base and lid are separately formed.

The base and lid can be secured together using a variety of different options. For example, the base and lid can be permanently sealed (e.g. welded) together to make it difficult to open and therefore tamper with the content of the package. However, permanently sealed packaging has a number of disadvantages. For example, permanently sealing the package can increase the cost of packaging because it may require the use of relatively expensive sealing equipment (e.g. a welder). Further, consumers have increasingly expressed resistance to the use of permanently sealed thermoformed packaging. Permanently sealed packages can be difficult to open, thereby providing a source of frustration for consumers. As a result of these (and perhaps other) disadvantages, there has been an effort to develop alternative packaging constructions that are not welded or otherwise permanently sealed. Some alternative constructions currently in use include a base and a lid that are snap-fitted together, and can therefore be relatively easily opened and closed simply by lifting the lid away from the base with enough force to overcome the snap-fit engagement.

In some applications, it can be desirable to provide a mechanism that allows a consumer to visually determine whether or not a package has been opened or otherwise tampered with. In packages that rely on snap-fit engagement between the lid and base, it is not uncommon to provide a construction in which a portion of the package must be bent or removed to open the lid. The bent portion or the absence of a removed portion provides a visual indication that the package has been opened or otherwise tampered with. For example, in some conventional packages of this type, the base includes a peripheral rail that surrounds and is closely aligned with the peripheral edge of the lid. The rail prevents easy access to the edge of the lid and thereby makes it difficult to remove the lid from the base. To obtain access to the edge of the lid, a portion of the base containing a section of the rail is capable of being folded down away from the edge of the lid. In this type of container, the movable portion of the base is often joined to the remainder of the base along a hinge disposed at its inner-most edge. In use, the movable portion is folded down along the hinge to gain access to the edge of the lid so that the edge of the lid can be gripped and used to lift the lid away from the base. It can be difficult to recognize when packages of this type have been tampered with. Depending on how far the movable portion is moved, it may not provide the container with sufficient visual discontinuity. Further, the problem can be compounded when, after the movable portion has been bent down, the shape memory of the material forming the hinge attempts to return the hinge to its original shape, thereby pulling the movable portion back into closer alignment with the peripheral edge of the lid.

SUMMARY OF THE INVENTION

The present invention provides a package having a lid seated on a base where the edge of the seated lid is generally inaccessible due to contours in the base, and where the edge of the lid is made accessible by forcing a movable section of the base down into a locked "opened" position where it is retained by the structure of the package. In one embodiment, the movable section is provided in the form of a tamper-evident tab that is joined to the base along a hinge. The tab may be situated in a corner of the package where it is readily accessible.

In one embodiment, the tamper-evident tab includes a protrusion that extends inwardly beyond the hinge. When the tamper-evident tab is forced down, the protrusion swings up and interacts with a corresponding retention feature in the lid to lock the tamper-evident tab into an opened position. The retention feature may have a catch portion that is configured to provide mechanical interference with movement of the protrusion as that tab is moved between the "closed" and "opened" positions. The retention feature may also have a cover portion that contains the protrusion once it has cleared the catch portion.

In one embodiment, the protrusion and retention feature are configured to create an audible snap when the protrusion passes into locking relationship with the retention feature. For example, movement of the tab may cause the protrusion to bend until it has enough tension to spring past the catch portion of retention feature and audibly engage the cover portion of the retention feature.

In one embodiment, the protrusion and retention feature may be configured so that the edge of the lid is tilted upwardly by movement of the tab into the "opened" position. For example, the protrusion may be longer than the depth of the retention feature so that engagement of the protrusion with the cover portion lifts the edge of the lid. The tilted edge of the lid may help to visually emphasize that the lid has been tampered with and may make it easier for a user to grip the edge and lift the lid.

In one embodiment, a fixed tab is disposed immediately adjacent to the movable tamper-evident tab. The fixed tab may provide a structure for holding the package with one hand while the other hand is used to bend the tamper-evident tab down into the locked "opened" position.

The present invention provides a simple tamper-evident tab arrangement that provides improved functionality and can be readily integrated into a wide range of thermoformed packages. The use of a locking tab arrangement helps to ensure that the tab is moved a sufficient distance to provide an obvious visual indication that the package has been opened. Further, because the tab is retained in the "opened" position, the tendency of the tab to return to its original position is overcome and the visual discontinuity associated with the "opened" tab will not lessen over time. If desired, the tab can be configured to lift the edge of the lid making it even easier to grip the edge from above and below. The locking tab arrangement may be configured to provide an evident audible response when the tab snaps into the "opened" position.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Figure 1:
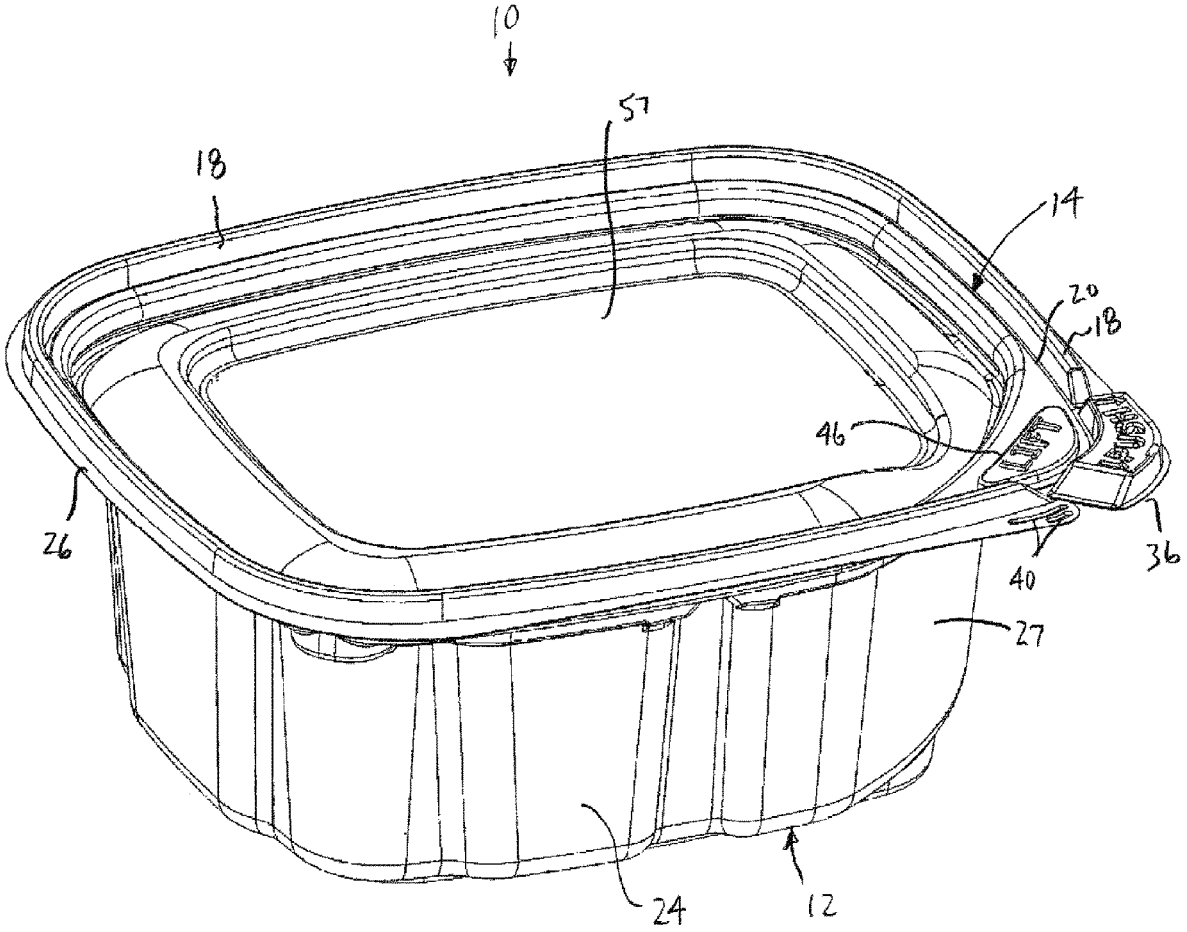
FIG. 1 is a perspective view of a package in accordance with an embodiment of the present invention.

A package having a tamper-evident tab arrangement in accordance with an embodiment of the present invention is shown in FIG. 1. The package 10 includes a base 12 and a lid 14. The base 12 is configured to receive items to be packaged and defines an opening 16 through which items can be placed into and removed from the package 10. The lid 14 is configured to close the opening 16 in the base 12. In the embodiment of FIG. 1, the base 12 includes a flange 26 and a rail 18 that extends around the opening 16. The lid 14 has a peripheral edge 20 having an outer shape that closely follows the inner shape of the rail 18. The edge 20 is shielded by the rail 18 to prevent a consumer from easily gripping the edge 20 to open the lid 14. The flange 26 includes a tamper-evident tab 36 that includes a portion of the rail 18 and is movable between "closed" and "opened" positions. In the closed position, the portion of the rail 18 carried by the tab 36 is aligned with the remainder of the rail 18 and shields the edge 20 of the lid 14 adjacent the tab 36. In the opened position, the tab 36 is bent into an alternative position that gives ready access to the peripheral edge 20 of the lid 14. The tamper-evident tab 36 is connected to the base 12 by hinge 42 and is configured to lock in the "opened" position. The tab 36 may include a protrusion 44 that interlocks with a retention feature 46 on the lid 14. The flange 26 may also include contours 40 adjacent to the tamper-evident tab 36 to provide a gripping structure to assist in moving the tamper-evident tab 36 into the opened position.

Although the present invention is described in connection with a package 10 intended for use in packaging food, such as fruits or vegetables, the present invention may be implemented in connection with packages intended for use in packaging other items. The size, shape and configuration of the package may vary from application to application, as desired. For example, the width, depth or shape of the base and/or lid may be varied to accommodate essentially any item or items to be packaged. The illustrated package 10 is intended to provide point-of-sale or point-of-purchase packaging for articles, but the present invention may be implemented in other types of packaging, if desired. It should also be noted that the present invention is illustrated in connection with a package 10 having a separate base 12 and lid 14. Alternatively, the present invention may be incorporated into a clamshell package in which the base and lid are joined along a living hinge.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

As noted above, the package of FIGS. 1-5 generally includes a base 12 and a lid 14 cooperatively defining an internal space for receiving an item (or items) to be packaged. In the illustrated embodiment, the package 10 is generally rectangular in shape as shown in FIGS. 1-8 and described below. However, the present invention may be incorporated into packages of essentially any size or shape. The lid 14 can be selectively installed on the base 12 to close the package 10. In this embodiment, the lid 14 is configured to snap onto the base 12. In the illustrated embodiment, the base 12 is configured to contain the bulk of the packaged item(s) and the lid 14 is configured primarily to close the open upper end of the base 12. In this embodiment, the base 12 is relatively deep and the lid 14 is relatively shallow, but the relative size and shape of the base 12 and lid 14 may vary from application to application. For example, the base 12 may alternatively be a relatively shallow tray and the lid 14 may form a relatively deep cover that contains the bulk of the packaged article(s).

Figure 2:
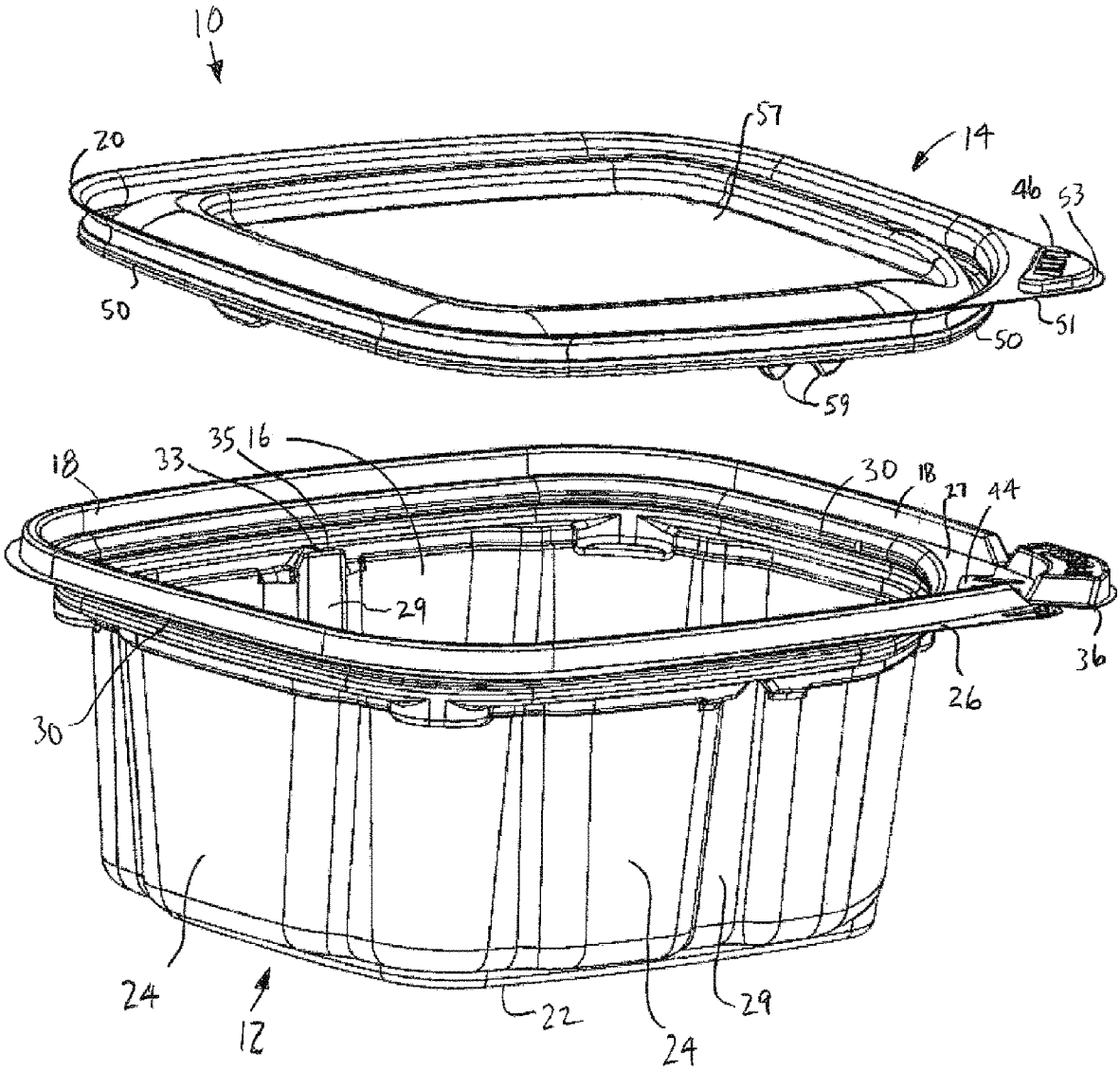
FIG. 2 is an exploded perspective view of the package.
Figure 3:
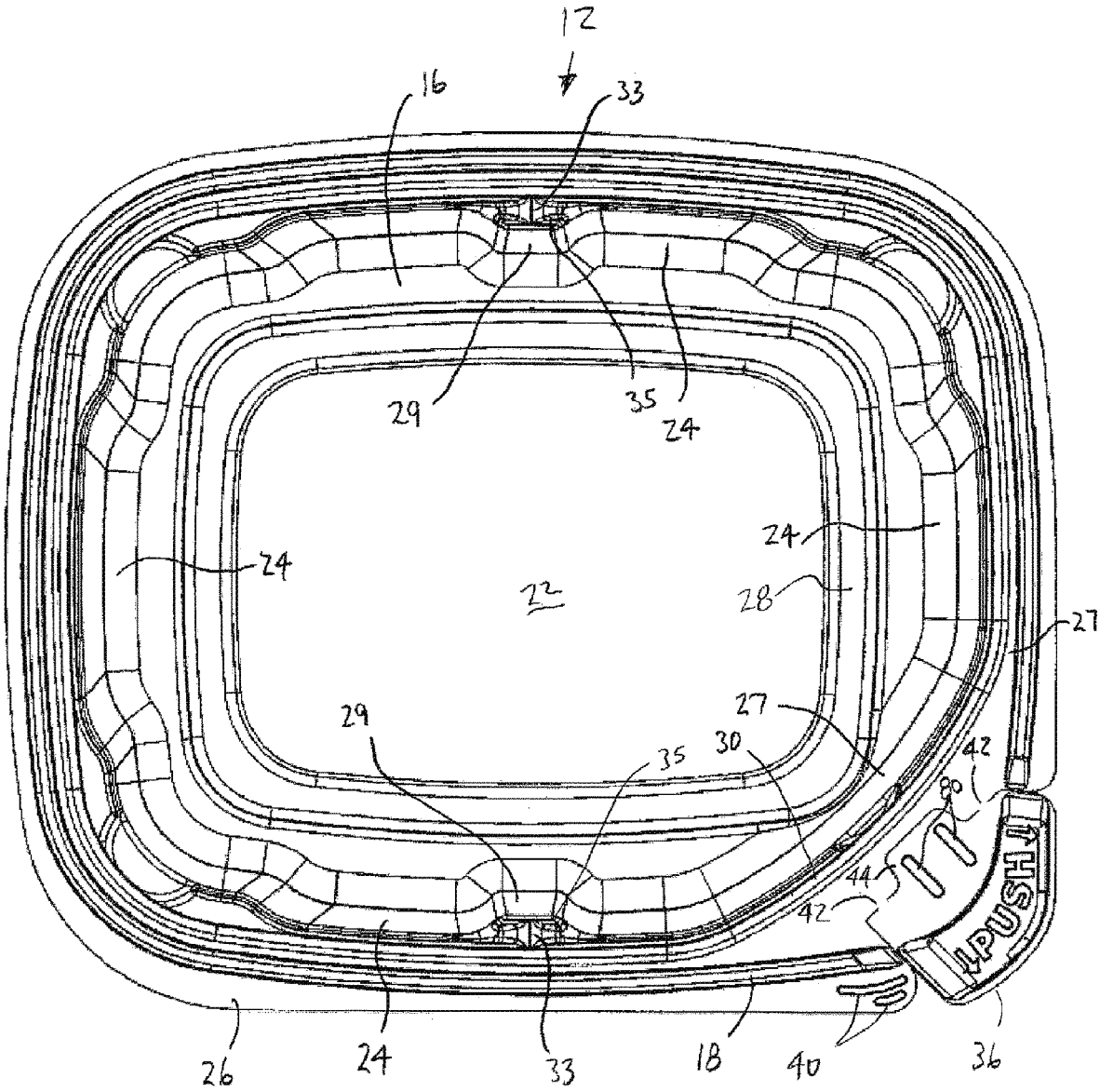
FIG. 3 is a top view of the base of the package.
Figure 4:
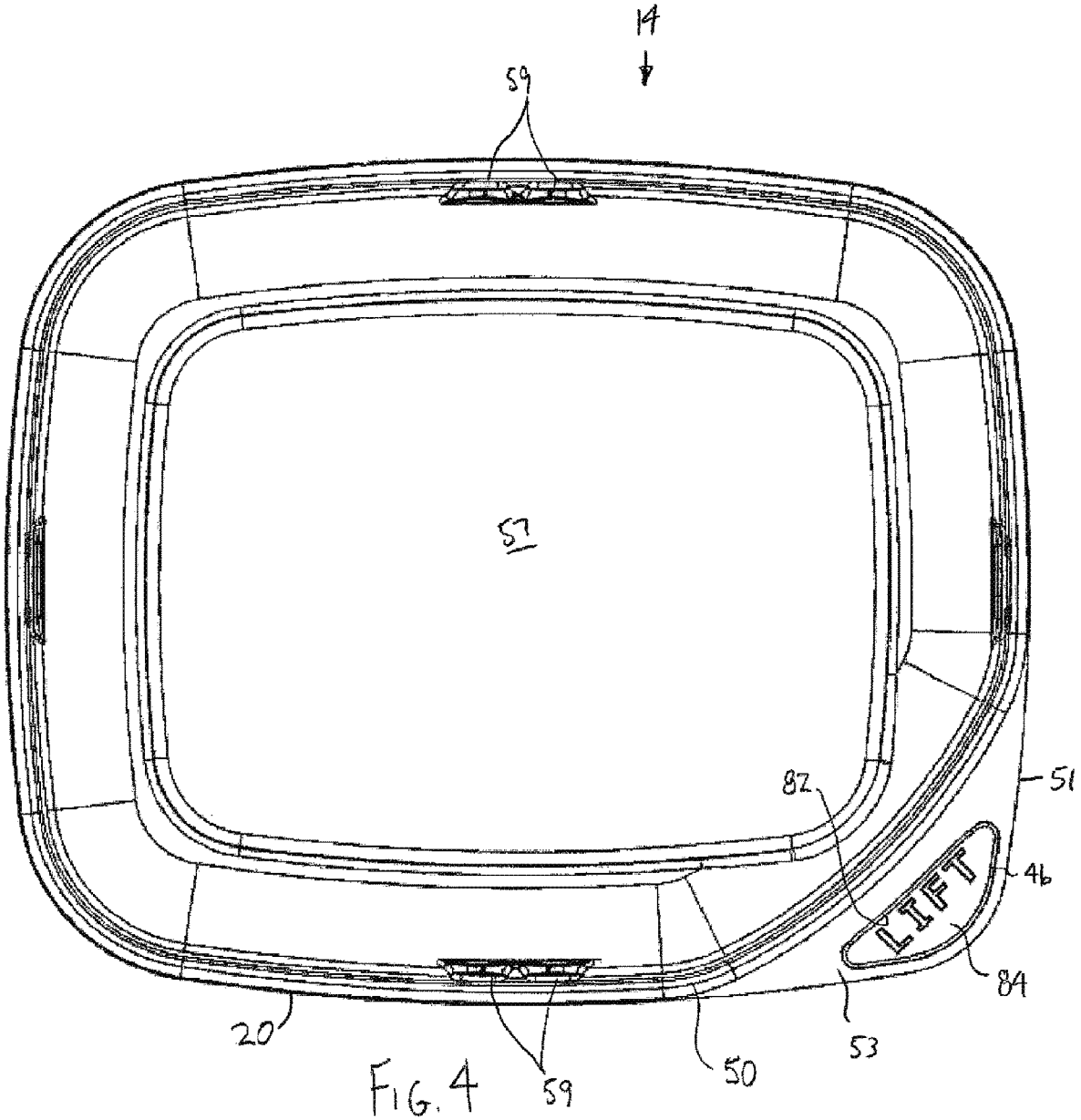
FIG. 4 is a top view of the lid of the package.
Figure 5:
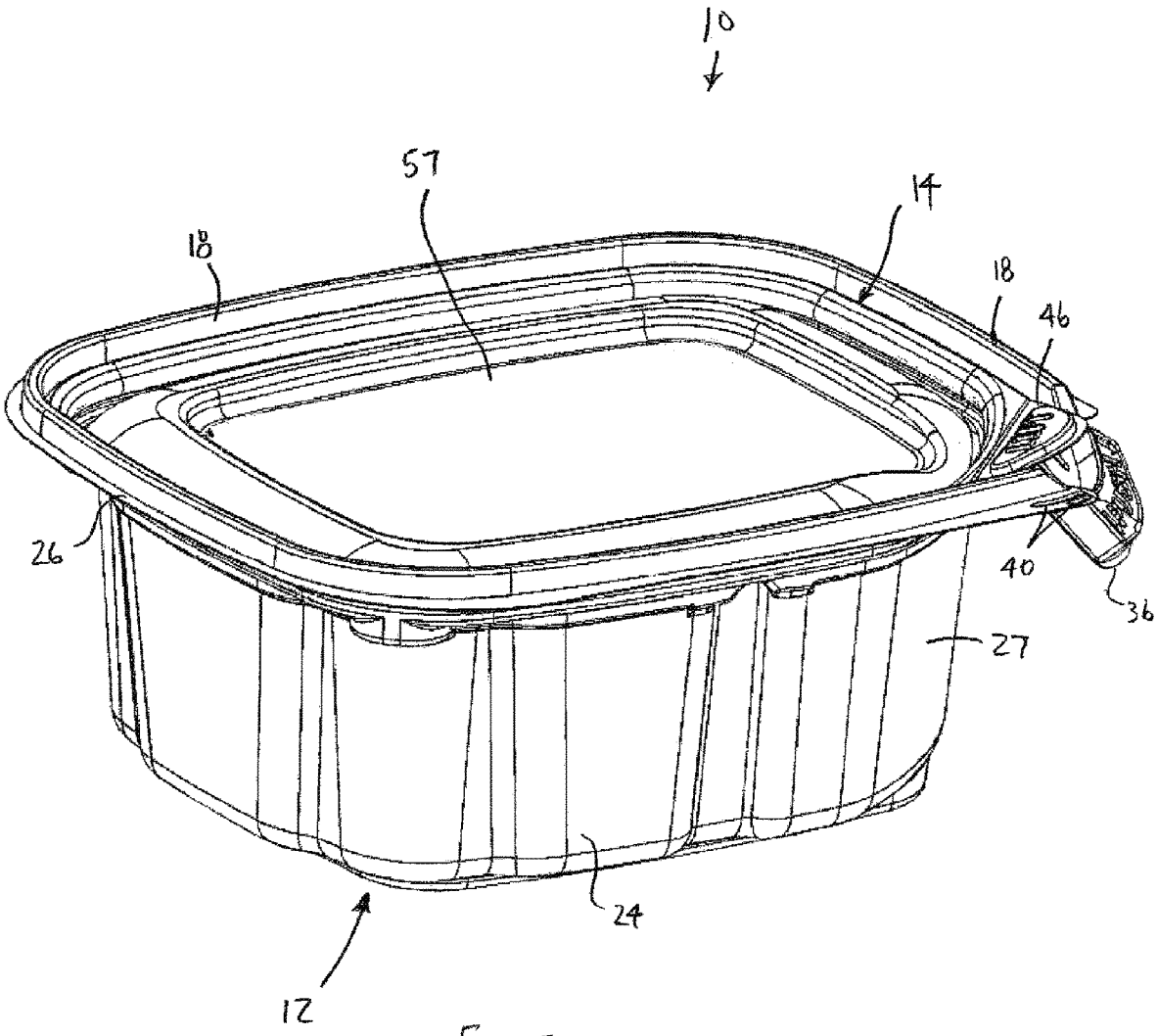
FIG. 5 is a perspective view of the package with the tamper-evident tab in the opened position.
Figure 6:
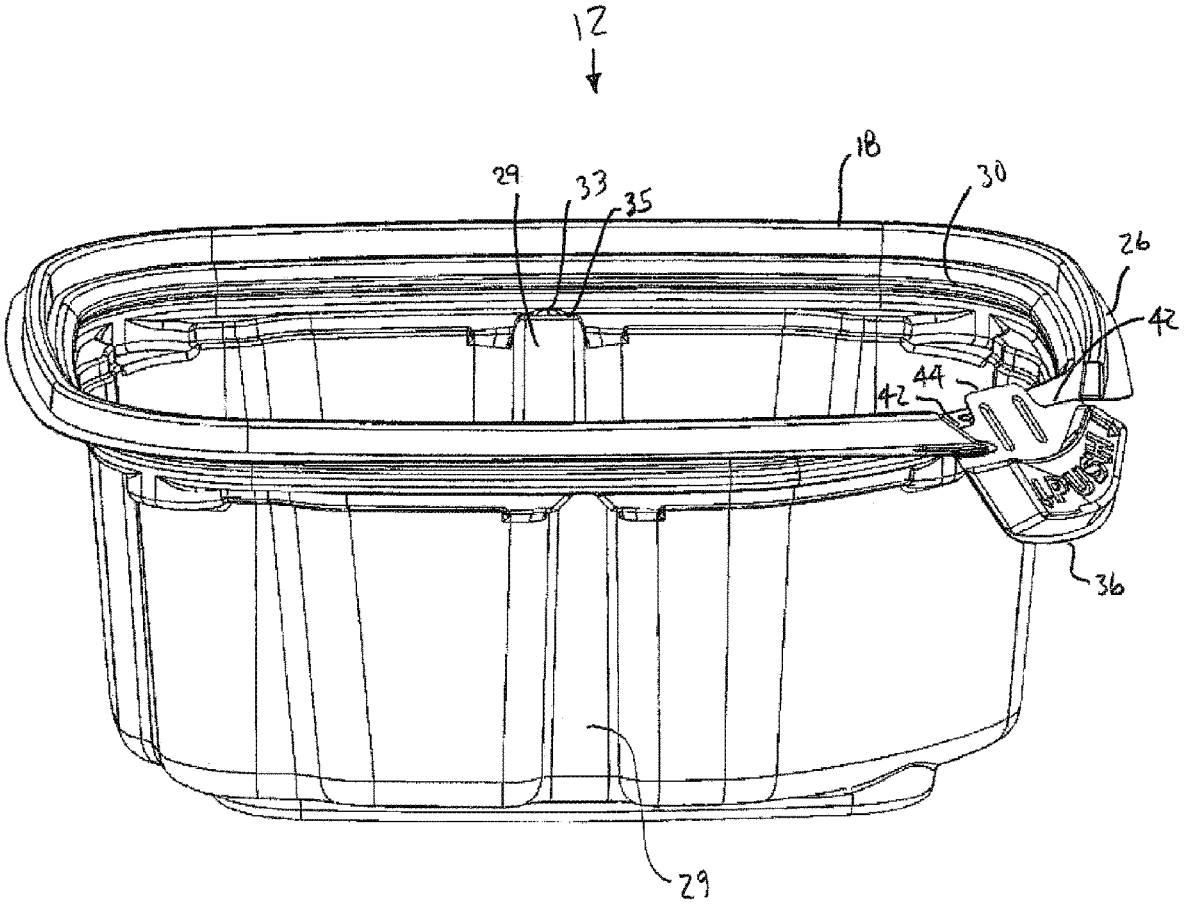
FIG. 6 is a perspective view of the package with the tamper-evident tab in the opened position and the lid removed to show details of the protrusion.

Referring now to FIGS. 2 and 3, the base 12 generally includes a bottom 22, a plurality of sidewalls 24 and a flange 26. The bottom 22, sidewalls 24 and flange 26 may be integrally thermoformed from a single sheet of stock material. In this embodiment, the bottom 22 is generally rectangular and may include contours, as desired. For example, the bottom of the base 12 may include a trough 28. The trough 28 may, among other things, provide a place to accumulate fluid, such as water that may run off of packaged fruits or vegetables. The trough 28 may also strengthen the base 12. The size, shape and configuration of the bottom 22 may vary from application to application, as desired. The trough 28 may be eliminated when not desired.

The sidewalls 24 of this embodiment extend upwardly from the peripheral edge of the bottom 22. In this embodiment, the sidewalls 24 correspond in shape with the bottom 22. More specifically, the sidewalls 24 of this embodiment are generally rectangular and have a slight outward taper from bottom to top. In this embodiment, the tamper-evident tab arrangement is positioned in a corner of the package 10. To accommodate the tamper-evident tab arrangement, the sidewalls 24 include a corner segment 27. The size, shape and configuration of the sidewalls 24 may vary from application to application, as desired. In the illustrated embodiment, a shoulder 30 is disposed toward the upper end of the sidewalls 24. In this embodiment, the shoulder 30 is configured to provide a structure for snap-locking the lid 14 into place on the base 12. The shoulder 30 of this embodiment is an annular structure that extends entirely around the periphery of the package 10. In this embodiment, the shoulder 30 is continuous, but it may be discontinuous or otherwise extend through only one or more portions of the periphery of the package 10. As perhaps best shown in FIGS. 7 and 8, the base shoulder 30 may be formed to define an undercut 32 that allows the shoulder 30 to receive a corresponding shoulder 50 formed into the lid 14 (described in more detail below). The interaction of these shoulders 30 and 50 allows the lid 14 to be snap-locked onto the base 12. The size, shape and configuration of the shoulder 30, including undercut 32, may be varied to control the amount of force required to install the lid 14 on the base 12 and to separate the lid 14 from the base 12.

The flange 26 extends outwardly from the upper end of the sidewalls 24 above shoulder 30 to form a peripheral lip extending around the top of base 12. In the illustrated embodiment, the flange 26 extends at an angle of just over ninety degrees from the sidewall 24 along a plane generally parallel to the bottom 22. The flange 26 includes a horizontal portion 27 that is configured to underlie the peripheral edge of the lid 14. The flange 26 of this embodiment generally includes a rail 18 that extends upwardly around the horizontal portion 27 of the flange 26. The rail 18 is configured to prevent access to the peripheral edge of the lid 14. To that end, the rail 18 includes an internal diameter that is only slightly greater than the external diameter of the lid 14. In this embodiment, the rail 18 is generally continuous except for a pair of relatively narrow breaks at opposite ends of the tamper-evident tab 36. The size, shape and configuration of the rail 18 may vary from application to application.

As noted above, the package includes a tamper-evident arrangement that is disposed in a corner of the package 10. In the illustrated embodiment, the tamper-evident arrangement is incorporated into the portion of the flange 26 extending from corner segment 27. The flange 26 includes a movable tamper-evident tab 36 that can be opened to provide access to a section of the peripheral edges of the lid 14 (as described in more detail below). In the illustrated embodiment, the tamper-evident tab 36 extends inwardly from the peripheral edge of the flange 26 through the rail 18 and into the horizontal portion 27 so that its movement into an open position provides access to a substantial portion of the peripheral edge of the lid 14. The tamper-evident tab 36 may extend into the horizontal portion 27 a distance sufficient to expose enough of the peripheral edge 20 to allow it to be firmly grasped between two fingers closing on the lid 14 from the top and bottom. The tamper-evident tab 36 of the illustrated embodiment is joined to the flange 26 by a hinge 42 and includes a protrusion 44. In the illustrated embodiment, the hinge 42 includes two hinge sections disposed on opposite side of protrusion 44, but the number of hinge sections may vary from application to application, as desired. The protrusion 44 extends inwardly from the hinge 42 to provide a structure that interacts with the lid 14 when the tamper-evident tab 36 is opened and closed. In the illustrated embodiment, the protrusion 44 is generally rectangular in shape and is of sufficient length to lift the edge 20 of the lid 14 somewhat when the tab is opened (as described in more detail below). The length of the protrusion 44 may vary from application to application, for example, to adjust how much the lid 14 is lifted. The protrusion 44 of the illustrated embodiment includes two parallel recesses 80 that are provided primarily to longitudinally reinforce the protrusion 44. The number, size, shape and configuration of the protrusion 44 and the recesses 80 may vary from application to application to control the characteristics of the tamper-evident arrangement. In the illustrated embodiment, hinge 42 is configured to bend as the tamper-evident tab 36 is moved into the "opened" position. The hinge 42 is configured to bend, but otherwise remain intact to prevent the tamper-evident tab 36 from separating from the base 12. The flange 26 may also include contours 40 disposed adjacent to the tamper-evident tab 36 to provide a structure that can be easily gripped by a user. In use, a user can open the tamper-evident tab 36 by gripping the flange 26 at the contours 40 with one hand and pushing down on the tramper-evident tab 36 with the other hand with enough force to move the tamper-evident tab 36 into the "opened" position (See FIG. 5). Although not shown, one or more lands (e.g. small sections of bridging material) may be situated between the tamper-evident tab 36 and adjacent portions of the flange 26 to resist movement of the tamper-evident tab 36. The lands may be created by including small nicks in the knives used to cut the edges of the tamper-evident tab 36 free from the flange 26. When included, the number, size, shape and location of the lands may be selected to provide the tab 36 with the desired separation characteristics. For example, in one embodiment, the tamper-evident tab 36 may include a single small land on the side adjacent the contours 40.

The base 12 may include additional aesthetic and functional features. For example, the sidewalls may include undulations or other contours that help to add structural rigidity. As another example, the sidewalls may include features that interfit with corresponding features in the lid 14 to help prevent the sidewalls 24 from bowing out when the package 10 is loaded. In this embodiment, two of the sidewalls 24 include a riser 29 that extends upwardly from the bottom 22 and terminates at its upper end in a T-shaped protrusion 31 having a central leg 33 and a cross leg 35 (See FIG. 3). The T-shaped protrusion 31 is configured to receive a pair of fingers 59 that extend downwardly from the lid 14 (See FIG. 2).

As noted above, the lid 14 is configured to be fitted onto the base 12 to close the package 10. In the illustrated embodiment, the lid 14 is generally rectangular and includes a peripheral edge 20 and a shoulder 50. The peripheral edge 20 is generally planar and is configured to lie against the horizontal portion of the flange 26 and terminate just inside the rail 18 (when the lid 14 is installed on the base 12). The spacing between the inside diameter of the rail 18 and the outside diameter of the peripheral edge 20 is small enough to make it difficult for a consumer to access the peripheral edge 20. The shoulder 50 of the lid 14 extends downwardly into the base 12 to interlock with the shoulder 30 of the base 12. The lid shoulder 50 is sized and shaped to fit tightly within the base shoulder 30, thereby providing a firm interlock (See FIGS. 7 and 8). In the illustrated embodiment, the lid 14, shoulder 50 and peripheral edge 20 are rectangular. The lid 14 of the illustrated includes a tamper evident corner 51 configured to interact with the tamper-evident tab arrangement. As perhaps best shown in FIGS. 7 and 8, the shoulder 50 extends at an angle of approximately forth five degrees through the tamper evident corner 51. The peripheral marginal portion of the lid 14 disposed outwardly from the shoulder 50 forms an enlarged lifting tab 53. In the illustrated embodiment, the lifting tab 53 is generally planar and includes a peripheral edge with the same general size and shape as the other corners of the lid 14. The size, shape and configuration of the lifting tab 53 may be varied from application to application by varying the shoulder 50 and the peripheral marginal portion of the lid 14 outside the shoulder 50 in the tamper-evident corner 51. The lid 14 includes a retention feature 46 that is configured to interact with the protrusion 44 of the tamper-evident tab 36. In the illustrated embodiment, the retention feature 46 is disposed in the lifting tab 53 and includes a raised portion 46. The innermost edge 82 of the raised portion 46 is configured to function as a catch that mechanically interferes with movement of the protrusion 44 when the tamper-evident tab 36 is moved between the closed and opened positions. The uppermost surface 84 of the raised portion 46 contains the protrusion 44 when the tamper-evident tab 36 is in the opened position.

The lid 14 may include additional contours, as desired, to provide strength or to implement aesthetic or functional features. For example, in the illustrate embodiment, the lid 14 includes a generally rectangular central planar cavity 57. The primary purpose of the cavity 57 is to receive a label (not shown). If desired, the cavity 57 may also be configured to closely receive the bottom of an above-stacked package 10 to provide nesting and improve the stability of stacked packages. Further, as noted above, the lid 14 and base 12 may include mating features that help to prevent the sidewalls 24 from bowing out. In this embodiment, the lid 14 includes a pair of small downwardly extending fingers 59 near the front and rear edges that mate with the T-shaped protrusions 31 in the long sidewalls 24. When the lid 14 is installed on the base 12, each pair of fingers 59 straddles the central leg 33 of the corresponding T-shaped protrusion 31 in the space between the cross leg 35 and the sidewalls 24.

Figure 7:
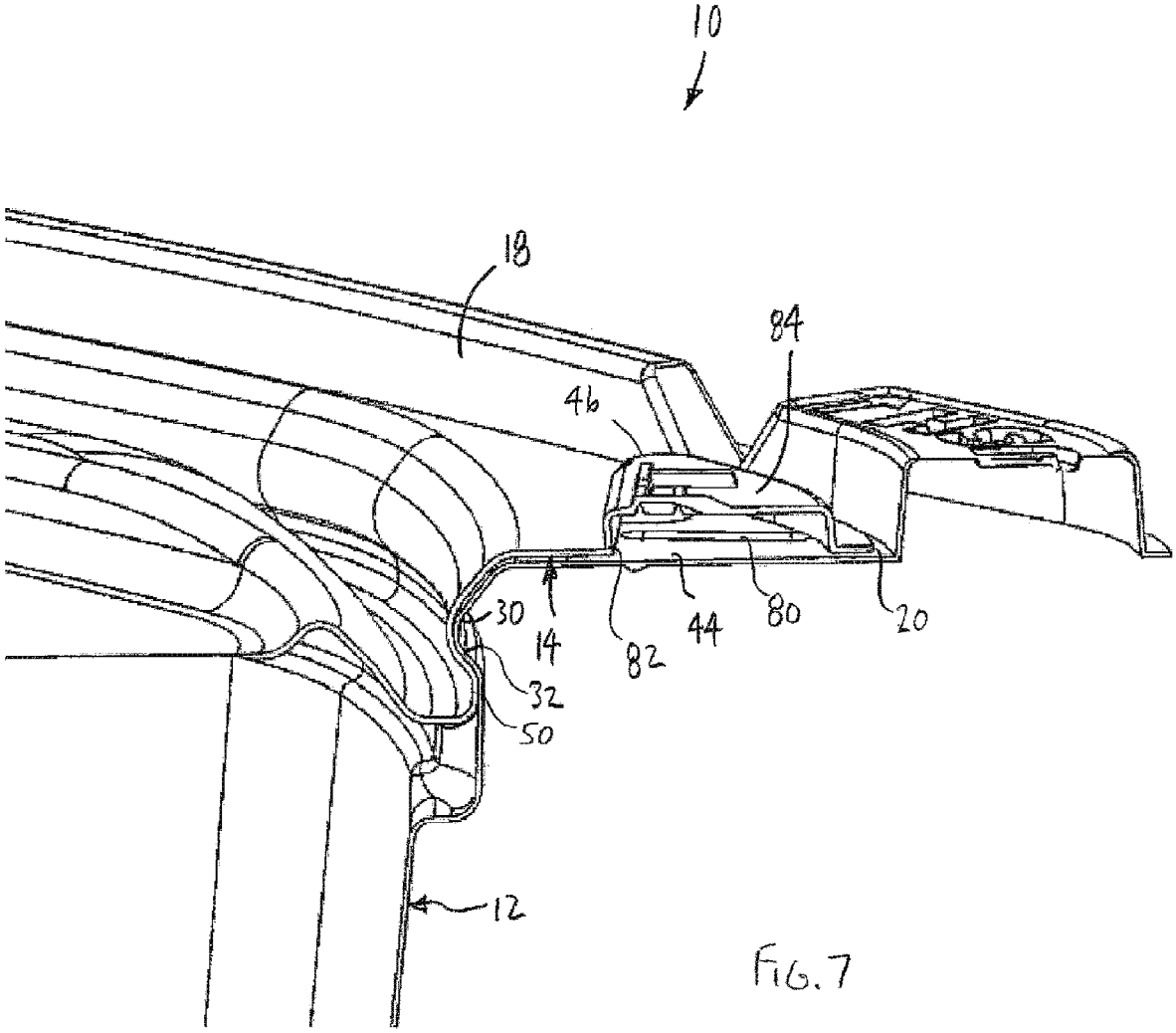
FIG. 7 is an enlarged cross-sectional view of the package showing a portion of the lid and the base with the tamper-evident tab in the "closed" position.
Figure 8:
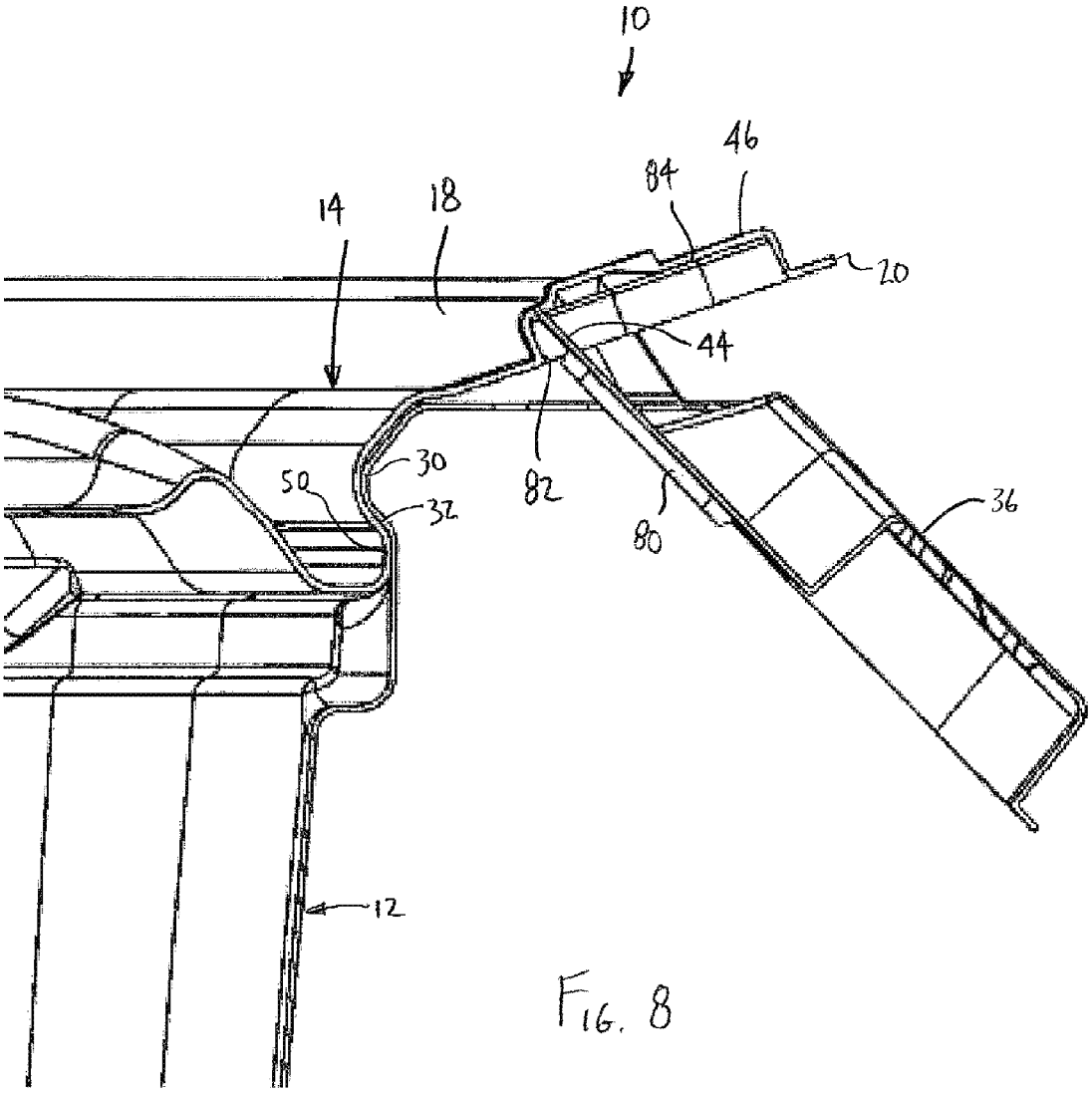
FIG. 8 is an enlarged cross-sectional view of the package showing a portion of the lid and the base with the tamper-evident tab in the "opened" position.

Operation of the tamper-evident arrangement of the present invention as implemented in package 10 will now be described with reference to FIGS. 7 and 8. When the lid 14 is installed on the base 12, the interlock between the lid shoulder 50 and the base shoulder 40 hold the lid 14 securely on the base 12. To remove the lid 14, it is generally beneficial to grip the peripheral edge 20 of the lid 14 and pull it upwardly away from the base 12. However, in the manufactured condition, the peripheral edge 20 of the lid 14 extends to within close proximity of the rail 18 making it difficult for a user to access the peripheral edge 20. To provide access to the peripheral edge 20, the tamper-evident tab 36 may be moved down into the "opened" position. The tamper-evident tab 36 extends into the horizontal portion of the flange 26 so that, once moved down, a user can grip the peripheral edge 20 of the lid 14 between two fingers closing on the edge 20 from top and bottom. To operate the tamper-evident tab 36, a user can grip the flange 26 at the contours 40 with one hand and the tamper evident tab 36 with the other hand, and then apply enough downward force to bend the tamper-evident tab 36 down about hinge 42 into the "opened" position. As the tamper-evident tab 36 is pushed down, the protrusion 44 will pivot up into engagement with the undersurface of the lid 14 adjacent to the retention feature 46. As the tamper-evident tab 36 is pushed farther, the protrusion 44 will increasingly bend and flex against the undersurface of the lid 14 until it reaches a point where it clears the edge 82 of the retention feature 46 and snaps up into the raised portion 46. This snapping action between the protrusion 44 and the raised portion 46 creates an audible indication that the tamper-evident tab 36 has been opened. In the illustrated embodiment, the protrusion 44 is retained in the corner between the edge 82 and the cover portion 84 (See FIG. 8). Once the tamper-evident tab 36 is moved down into the opened position, it will not only expose a portion of the peripheral edge 20 of the lid 14, but also provide an obvious visual indication that the package 10 has been tampered with or opened. In this embodiment, the length of the protrusion 44 is selected so that it extends farther than the upper surface of the raised portion 46. As a result, when the tamper-evident tab 36 is opened, the protrusion 44 lifts the raised portion of the lid 14 away from the base 12 making it easier to grip the lid 14 and more obvious that the tamper-evident tab 36 has been opened.

In this embodiment, the tamper evident arrangement is incorporated into a corner of the package 10, but it can be located in other positions as desired. For example, the tamper evident arrangement may be situated in a central portion of one of the sides of the package. The tamper evident arrangement may be incorporated into packages of different size and shapes. For example, the tamper evident arrangement may be incorporated into a circular package. With circular packages, the tamper evident arrangement may be location at essentially any location around the circumference of the package.

To provide a large tamper evident arrangement while still having efficient use of shelf space, the package 10 may be shaped so that the tamper evident arrangement substantially fills the space between adjacent packages 10 when placed immediately adjacent to one another on a shelf. More specifically, the shallow curves in the sidewalls 24 cause the corners of the package 10 to be recessed or inset from the outermost extents of the package 10. The corner segment 27 is inset even farther from the outermost extent to provide additional space for the tamper evident arrangement. The dimensions of the flange 26 and tamper-evident tab 36 are selected so that the tamper-evident tab 36 and flange 26 substantially fill the available space when packages 10 are stacked in an array on a shelf.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A thermoformed package comprising:

a thermoformed base having an outwardly extending flange extending around at least a portion of a periphery of said base;

a thermoformed lid seated on said base, said lid having a peripheral edge, a portion of said peripheral edge forming a lifting tab, said flange impeding access to said peripheral edge and said lifting tab; and wherein said flange includes an integral tamper-evident tab selectively movable between a closed position and an opened position, said tamper-evident tab movably with respect to a remainder of said flange, said tamper-evident tab including a first retention feature configured to mechanically interact with said lifting tab, said tamper-evident tab underlying and impeding access to said lifting tab when in said closed position, movement of said tamper-evident tab from said closed position into said opened position creating separation between said lifting tab and said tamper-evident tab and causing said first retention feature to interact with said lifting tab to maintain said separation between said lifting tab and said tamper-evident tab, whereby said lifting tab is readily accessible and can be gripped by a user and used to lift said lid from said base.

2. The thermoformed package of claim 1 wherein said lifting tab includes a catch portion presenting mechanical interference to movement of said tamper-evident tab between said closed position and said opened position.

3. The thermoformed package of claim 2 wherein said lifting tab includes a cover portion mechanically retaining said first retention feature when said tamper-evident tab is in said opened position.

4. The thermoformed package of claim 3 wherein tamper-evident tab is joined to said base by a hinge, said hinge includes a pair of hinge sections disposed on opposite sides of said first retention feature.

5. The thermoformed package of claim 4 wherein said first retention feature includes at least one structural contour configured to reinforce said first retention feature against bending.

6. The thermoformed package of claim 5 wherein said lifting tab has a second retention feature with a depth, said first retention feature having a length greater than said depth so that when said tamper-evident tab is in said opened position, said first retention feature urges said lifting tab away from said base.

7. The thermoformed package of claim 6 wherein said base and said lid are generally rectangular, said tamper-evident tab being disposed in a corner of said base.

8. The thermoformed package of claim 7 wherein said first retention feature is configured to snap into contact with said cover portion to provide an audible indication when said tamper-evident tab is moved into said opened position.

9. A thermoformed package comprising:

a base defining an interior for containing one or more packaged articles and an opening providing access to said interior, said base including a flange extending around at least a portion of said opening, said flange including an upwardly extending rail extending around at least a portion of said flange, said flange including a tamper-evident tab movable from a closed position to an opened position, said tamper-evident tab joined to said flange along an inner edge; and a lid releasably seated on said base over said opening, said lid terminating in a peripheral edge, at least a portion of said peripheral edge disposed adjacent to said rail when said lid is seated on said base, whereby said rail impedes access to at least a portion of said peripheral edge when said lid is seated on said base, said lid including a lifting tab adjacent said tamper-evident tab;

wherein said lifting tab includes a first retention feature and said tamper-evident tab includes a second retention feature configured to interact with said first retention feature when said tamper-evident tab is moved between said closed and said opened positions; and wherein movement of said tamper-evident tab from said closed position to said opened position creates separation between said lifting tab and said tamper-evident tab and moves said second retention feature into engagement with said first retention feature to maintain separation between said lifting tab and said tamper-evident tab and to secure said tamper-evident tab in said opened position.

10. The thermoformed package of claim 9 wherein said first retention feature includes a catch portion presenting mechanical interference to movement of said tamper-evident tab between said closed position and said opened position.

11. The thermoformed package of claim 10 wherein said first retention feature includes a cover portion retaining said second retention feature when said tamper-evident tab is in said opened position.

12. The thermoformed package of claim 11 wherein said second retention feature is configured to snap into engagement with said cover portion to provide an audible indication when said tamper-evident tab is moved into said opened position.

13. The thermoformed package of claim 9 wherein said tamper-evident tab includes a hinge with a pair of hinge sections disposed on opposite sides of said second retention feature.

14. The thermoformed package of claim 13 wherein said second retention feature includes at least one structural contour configured to reinforce said second retention feature against bending.

15. The thermoformed package of claim 14 wherein said first retention feature has a depth and said second retention feature has a length greater than said depth so that when said tamper-evident tab is in said opened position, said second retention feature urges said lid away from said base.

16. A tamper-evident food package comprising:

top and bottom parts capable of being selectively interlocked to close the package, said top and bottom parts shaped to cooperatively define an article-receiving space when interlocked, said bottom part including a circumferential flange, said top part including a peripheral edge, said flange configured to impede access to said peripheral edge, said top part further including a lifting tab, said lifting tab including a portion of said peripheral edge;

wherein said flange includes a tamper-evident tab movable between a closed position and an opened position, said tamper-evident tab having an inner edge joined to said flange, said tamper-evident tab having a retention feature underlying said lifting tab, wherein movement of said tamper-evident tab to said opened position creates separation between said lifting tab and said tamper-evident tab to expose said portion of said peripheral edge on said lifting tab and moves said retention feature into retaining engagement with said lifting tab such that interaction between said retention feature and said lifting tab retains said tamper-evident tab in said opened position and maintains said separation between said lifting tab and said tamper-evident tab.

17. The tamper-evident food package of claim 16 wherein said lifting tab includes a catch portion disposed in a path of said retention feature when said tamper-evident tab is moved between said closed position and said opened position, whereby said catch portion provides mechanical interference to movement of said tamper-evident tab.

18. The tamper-evident food package of claim 16 wherein said lifting tab includes a cover portion retaining said retention feature when said tamper-evident tab is in said opened position, said retention feature configured to snap into engagement with said cover portion to provide an audible indication when said tamper-evident tab is moved into said opened position.

19. The tamper-evident food package of claim 18 wherein said tamper-evident tab includes a hinge having a pair of hinge sections disposed on opposite sides of said retention feature.

20. The tamper-evident food package of claim 19 wherein said catch has a depth and said retention feature has a length greater than said depth so that when said tamper-evident tab is in said opened position, said retention feature urges said lifting tab away from said tamper-evident tab.

* * * * *